US006323832B1

(12) United States Patent
Nishizawa et al.

(10) Patent No.: US 6,323,832 B1
(45) Date of Patent: Nov. 27, 2001

(54) COLOR DISPLAY DEVICE

(75) Inventors: Junichi Nishizawa, No. 6-16, Komegafukuro 1-chome, Sendai-shi, Miyagi (JP); Yoshikatsu Tamaoki, Miyagi (JP)

(73) Assignee: Junichi Nishizawa, Miyagi (JP)

( * ) Notice: Subject to any disclaimer, the term of this patent is extended or adjusted under 35 U.S.C. 154(b) by 0 days.

(21) Appl. No.: 08/152,102

(22) Filed: Nov. 15, 1993

Related U.S. Application Data

(6263) Continuation of application No. 07/873,335, filed on Apr. 20, 1992, which is a continuation of application No. 07/221,566, filed as application No. PCT/JP87/00707 on Sep. 25, 1987, now abandoned.

(30) Foreign Application Priority Data

Sep. 27, 1986 (JP) ..... 61-229057

(51) Int. Cl.[7] ..... G09G 3/32

(52) U.S. Cl. ..... 345/83; 40/427; 40/541; 313/500; 362/800

(58) Field of Search ..... 345/82, 83, 33; 313/500; 40/427, 541; 362/227, 240, 800, 812; 340/815.4

(56) References Cited

U.S. PATENT DOCUMENTS 3,894,225 * 7/1975 Chao ..... 362/812
4,173,035 * 10/1979 Hoyt ..... 362/812
4,439,818 * 3/1984 Scheib ..... 362/800
4,441,106 * 4/1984 Jackson ..... 340/762
4,488,149 * 12/1984 Givens, Jr. ..... 340/702
4,689,618 * 8/1987 Hikichi ..... 340/762
4,733,127 * 3/1988 Takasu et al. ..... 340/762
4,965,561 * 10/1990 Havel ..... 340/762

FOREIGN PATENT DOCUMENTS

56148845 * 3/1983 (JP) .
SP881416 * 8/1985 (JP) .
61132988 * 6/1986 (JP) .
50-74931 * 6/1995 (JP) .

* cited by examiner

*Primary Examiner*—Richard Hjerpe
*Assistant Examiner*—Mike Fatahiyar
(74) *Attorney, Agent, or Firm*—Sughrue, Mion, Zinn, Macpeak & Seas, PLLC

(57) ABSTRACT

A color display device in which a plurality of units are arranged in a matrix, each unit having collectively disposed three light emission diodes of three colors, for example, red, yellowish green, and blue, and in which emission intensity and a luminous color of each light emission diode can be controlled by supplying each light emission diode with a time series electric pulse while varying its intensity and width.

In the device according to the present invention, the electrodes are provided collectively on one side of the flexible insulator substrate and multilayer wiring is formed by evaporation or plating on the substrate so that the device has an advantage which could not obtained in the conventional display devices in that the display portion thereof can be rolled.

24 Claims, 3 Drawing Sheets

COLOR DISPLAY DEVICE

This is a Continuation of application Ser. No. 07/873,335 filed Apr. 20, 1992, which is a Continuation Application of application Ser. No. 07/221,566 filed on Jul. 19, 1988 is now abandonded, which is a 371 of PCT/JP87/00707 filed Sep. 25, 1987.

TECHNICAL FIELD

The present invention relates to a color display device which utilizes a plurality of luminous elements having luminous wavelengths different from each other and which is used for performing display of various size, large-sized display as well as small-sized display. Further, the color display device according to the present invention includes a color display device having a display portion which can be rolled.

BACKGROUND ART

Color display devices are used in color television sets, a variety of display lamps, large-sized color television sets, or the like, and are grouped into the color display devices of the cathode-ray tube system, of the liquid crystal system, and the like.

All the conventional color display devices, however, have disadvantages in that sensitivity is poor and a clear display picture cannot be obtained, and in that the device per se is large in size and the power consumption is large.

Further, in the conventional color display devices having display portions of the cathode-ray tube system as well as of the liquid crystal system, the display portion cannot be bent because of the limitations on the system, or because of the quality/material and shape of the display portion.

The present invention has been attained to eliminate the foregoing disadvantages in the conventional devices, and an object of the present invention is to provide a color display device in which a plurality of luminous elements having luminous wavelengths different from each other are used so that desired visible light is produced and displayed by combining light on the basis of time series pulses.

Another object of the present invention is to provide a color display device which can be bent.

DISCLOSURE OF THE INVENTION

In the color display device according to the present invention, a plurality of luminous elements having luminous wavelengths different from each other are disposed collectively so that display is performed while controlling the emission intensity and luminous colors of the luminous elements on the basis of time series pulses.

The luminous elements, for example, of three luminous colors, red, yellowish green, and blue, are disposed collectively at one point. In the case where color correction cannot be sufficiently performed, it is a matter of course that some luminous elements may be added to the three luminous elements.

If light emission diodes are used as the luminous elements, they are superior in performance, reliability, cost, life, etc., to any other kind of luminous elements. The light emission diodes can emit desired luminous colors by changing the kind of the material and impurity thereof.

That is, in the color display device according to the present invention, a plurality of luminous elements having luminous wavelengths different from each other are used so that desired visible light is obtained and displayed by combination of emitted light on the basis of time series pulses. Further, the color display device according to the present invention has such a function that the device itself or a display portion thereof can be bent by performing wiring in either the vertical direction or the horizontal direction by evaporation, plating, or the like.

THE BEST MODE OF EMBODIMENT OF THE INVENTION

Figure 1:
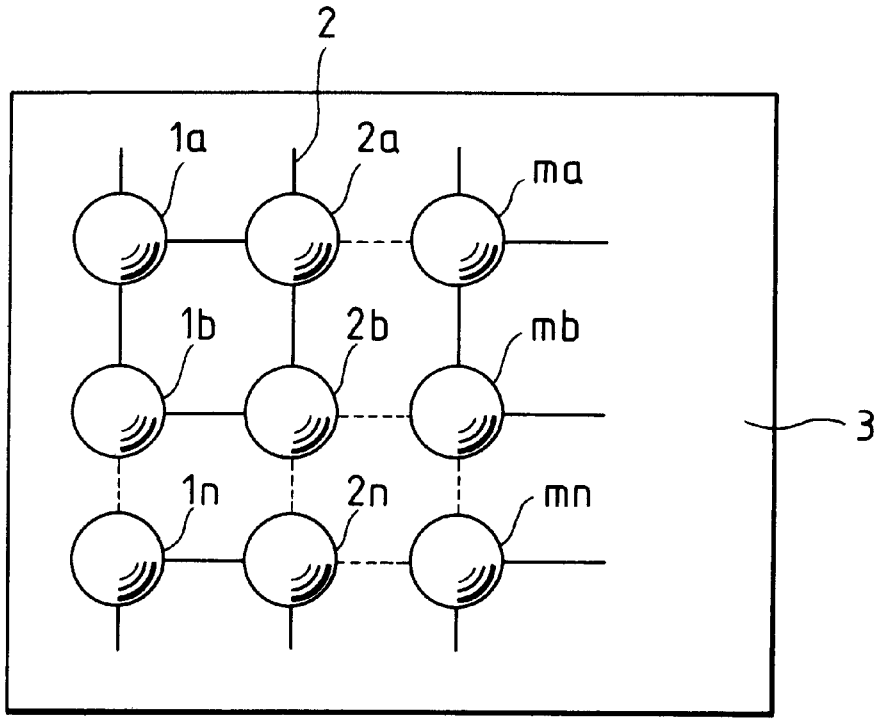
FIG. 1 is a diagram for explaining the color display device according to the present invention.

FIG. 1 is a diagram for explaining the color display device according to the present invention, and illustrating one picture element having a matrix structure.

In the drawing, 1*a,* 1*b,* . . . mn designate luminous bodies arranged in a matrix; 2, wiring connecting the plurality of luminous bodies 1*a,* 1*b,* . . . mn to each other and for sending time series pulses therethrough; and 3, an insulator substrate on which the luminous bodies 1*a,* 1*b,* . . . mn and the wiring 2 are disposed.

The luminous bodies 1*a,* 1*b,* . . . mn in this example are a plurality of light emission diodes having luminous wavelengths different from each other. A desired color can be produced by combining light of the three primary colors, that is, red, yellowish green, and blue. Therefore, it is possible to obtain light of a desired color by combining light emitted from the collectively disposed light emission diodes of the three colors while varying the emission intensity of the light emission diodes.

In the case of the light emission diodes, a half-amplitude level of a emission spectrum is small to be tens nm, and it becomes sometimes impossible to sufficiently perform color correction of a half tone color by use of only the three colors. In this case, if some other light emission diodes having luminous wavelengths different from the three colors are added to the light emission diodes of the three colors to thereby make it possible to obtain a desired color of visible light by combining light emitted from those light emission diodes.

In the color display, device, each of the luminous bodies 1*a,* 1*b,* . . . mn forms one picture element. The structure may be made by collectively molding a plurality of light emission diodes or by concentrating a plurality of separately molded light emission diodes. An element (chip) of the light emission diode has a small size of about 300 $\mu$m×300 $\mu$m, and can be more reduced in size. Therefore, even if a plurality of light emission diodes, for example, three or five light emission diodes, are integrally molded, the whole of the molded light emission diodes can be made small in size without lowering the picture resolution of the color display, device.

Figure 2A:
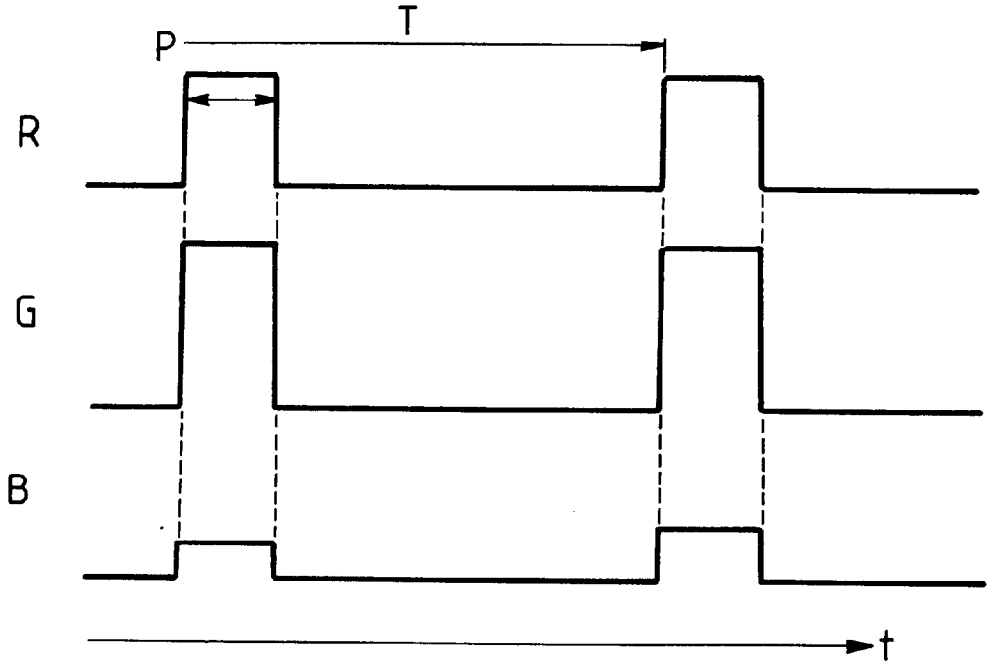
FIGS. 2(*a*) through 2(*c*) are diagrams for explaining the operation of the color display device according to the present invention.
Figure 2B:
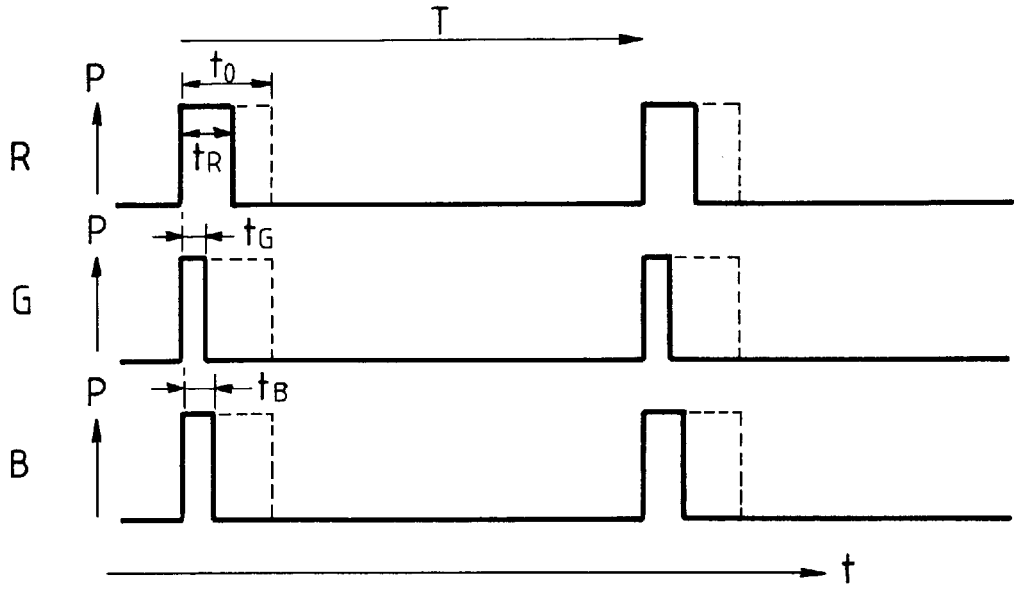
Figure 2C:
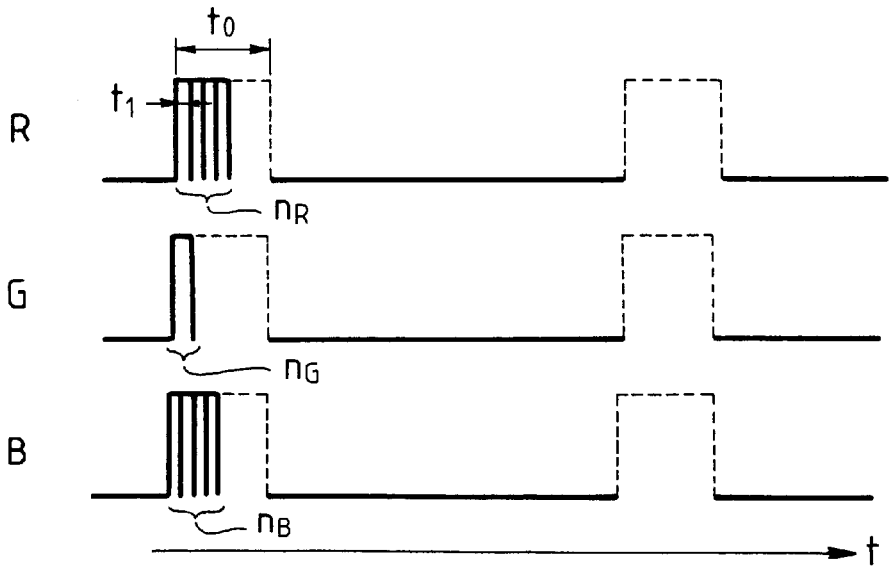

FIG. 2(*a*) is a diagram for explaining an example of the time chart of the time series pulses for luminous bodies when desired visible light is formed. In the drawing, the abscissa represents time t, the ordinate represents a light output p, and R, G, and B designate signals of red, yellowish green, and blue colors respectively. T designates a pulse period which is determined by a scanning frequency. A pulse width $t_0$ is a period of time which is determined by the number of luminous bodies (the number of all the picture elements). Colors of light emitted from the luminous bodies are controlled by a ratio of current values for the colors of red R, yellowish green G, and blue B. That is, a color is produced by varying a ratio of current values flowing in the respective luminous bodies. For example, in the case of producing an orange color, currents are made to flow with a predetermined ratio into the respective luminous bodies of red R and yellowish green G while the luminous body of blue B is not turned on. The ratio is determined by efficiency of the luminous bodies, the visibility of eyes of a person, or the like.

FIG. 2(*b*) shows an embodiment in the case where a color is produced by combination of light having pulse widths different from each other from the luminous bodies. A pulse width of each of the luminous bodies can be varied to the maximum value $t_0$, and it is possible to obtain desired light by combination of light while controlling a time ratio between $t_R$, $t_G$, and $t_B$ in an analog manner.

FIG. 2(*c*) shows an embodiment in the case where a color is produced by combination of light from the luminous bodies which are different in the number of light pulses from each other. Each of the luminous bodies is driven by a carrier frequency having a pulse width $t_1$ which is sufficiently smaller than the foregoing pulse width $t_0$. It is possible to produce a desired color by combining light while changing the ratio among the respective numbers of pulses within $t_0$ (the ratio among $n_R$, $n_G$, and $n_B$). It is a matter of course that the emission intensity can be controlled by varying the light output.

Figure 3A:
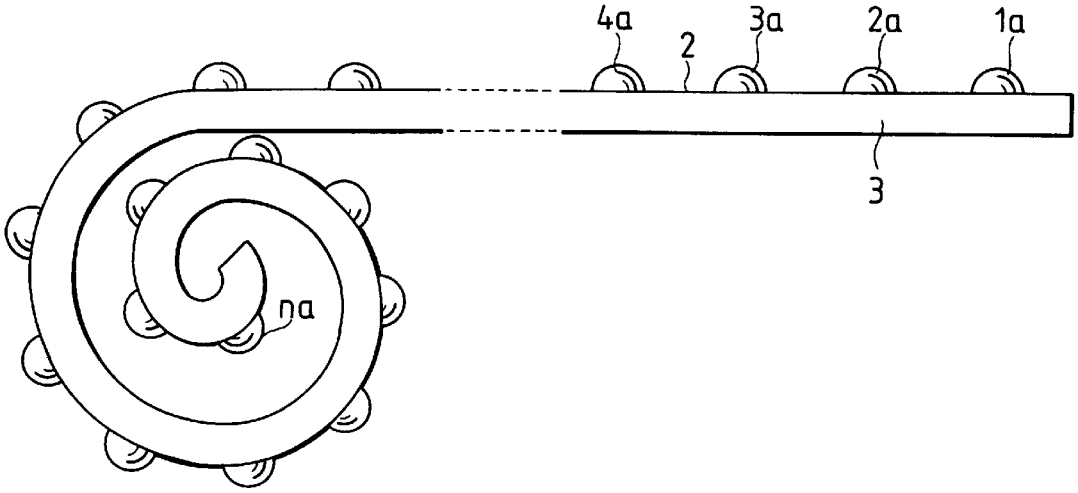
FIGS. 3(*a*) and 3(*b*) are diagrams showing specific examples of the present invention.
Figure 3B:
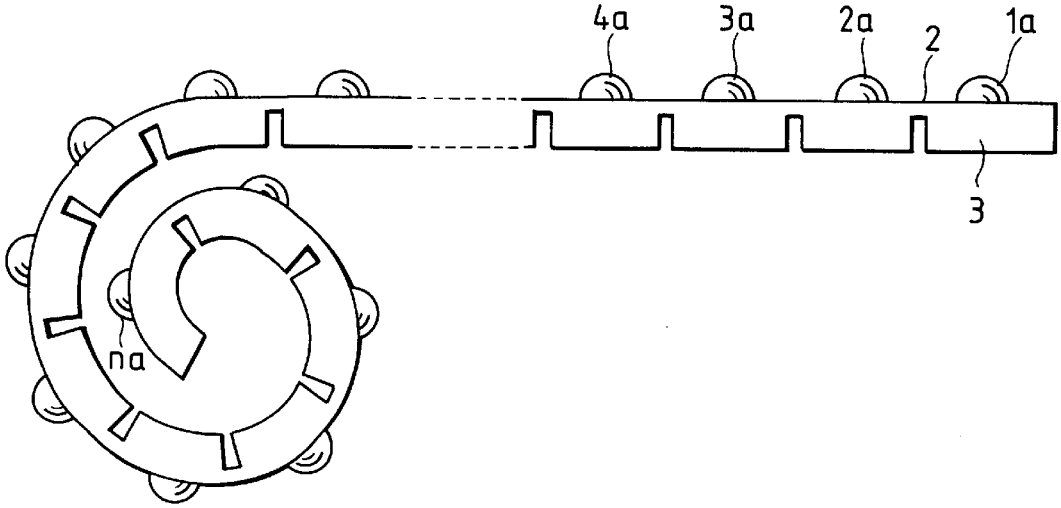

FIGS. 3(*a*) and 3(*b*) show further embodiments of the present invention which are specified examples in which a color display, device can be bent.

The devices of FIGS. 3(*a*) and (*b*) are obtained in a manner so that the insulator substrate 3 is formed by using a flexible or soft material and the wiring 2 is formed only on one side of the substrate 3 by evaporation or plating of Al, Au, or the like in FIG. 1.

In these examples, the substrate 3 of a flexible or soft insulating material is used, and the degree of bending of the color display device varies depending on the stiffness and thickness of the soft insulator material or the thickness of the material of the wiring. However, the color display, device which can be bent is realized by concentrating the wiring only on one side.

Further, the device capable of being bent more easily can be realized if thin layers are periodically formed in the soft insulator substrate 3 as shown in FIG. 3(*b*).

Power wiring and signal wiring are connected to luminous elements and arranged in a matrix. In order to simplify a wiring network, to prevent mutual interference due to wiring impedance, and to make the speed of signal transmission high, it is possible to improve the effects by making at least one of the power and signal wiring common. For example, wiring may be collectively formed for every color, or common wiring may be formed for every row or column in accordance with the use of color display devices.

Thus, in the case where a plurality of luminous elements are arranged in a matrix, two-dimensional formation of common wiring provides advantages such as simplification, high-speed signal processing, etc.

Further, it is possible to obtain a structure capable of being bent also in the opposite direction if the wiring from the luminous bodies 1*a,* 1*b,* . . . 1*n* is passed through the inside of the soft insulator substrate 3 and the wiring 2 is formed collectively only on the side opposite to the side on which the luminous bodies 1*a,* 1*b,* . . . 1*n* are disposed.

It is a matter of course that the color display device according to the present invention is not limited to the foregoing specific embodiments.

POSSIBILITY OF INDUSTRIAL UTILIZATION

The color display device according to the present invention is made thin in comparison with the conventional color display device of the cathode-ray tube system because a plurality of luminous elements having luminous wavelengths different from each other are used so that desired visible light is produced by combining light on the basis of time series pulses. Therefore, the color display device can be realized not only in the form of a flat, wall type color display device, but as a color display device of high sensitivity, without distinction of the size whether the device is large or small. Further, in the case where light emission diodes are used as the luminous elements, the color display device according to the present invention has an advantage in that a very bright picture can be obtained with small electric power and with high resolution in comparison with the case of using other kind of luminous elements. Further, the device has an advantage in that the whole device or the display portion can be formed to have a shape which can be bent if the wiring of the electrodes on one side of the flexible substrate is formed by evaporation, plating or the like, and therefore the device can be carried in a rolled state.

As described above, the color display device according to the present invention has many advantages in comparison with the conventional one, and therefore has a large industrial merit.

What is claimed is:

1. A two-dimensional color display device allowing selective generation and display of a broad range of colors, said device comprising:

a plurality of luminous elements each having luminous wavelengths different from each other collectively disposed on a flexible substrate in an N×M matrix arrangement, said flexible substrate being periodically thinned so as to facilitate rolling of the device, at least one of emission intensity and a luminous color of each of said luminous elements being separately controllable from those of other ones of said luminous elements, said controllability being conducted on the basis of selective variation of at least one of a time series pulse intensity and a width which is applied to said luminous element, such that each luminous element emits a desired emission intensity and luminous color, and a collective emission intensity and luminous color of adjacent ones of said luminous elements effect display of a desired color, and one of said luminous elements being controlled so that the emission intensity thereof is different from the emission intensity of at least one other luminous element when said one and said at least one other luminous element emit light, and wherein N and M are each an integer not less than 2; and signal wiring connected to said luminous elements, said signal wiring being arranged in a matrix.

2. A color display according to claim 1, further comprising wiring for interconnecting said plurality of luminous elements, said wiring being disposed on said flexible substrate such that said substrate can be bent.

3. A color display according to claim 1, wherein said flexible substrate has a stiffness and a thickness such that said substrate can be bent.

4. The two-dimensional color display device as defined in claim 1, wherein said substrate includes notches between rows and columns of said matrix so as to facilitate rolling of the device.

5. The two-dimensional color display device as defined in claim 1, wherein said matrix of signal wiring is arranged such that common wiring is formed for every row.

6. The two-dimensional color display device as defined in claim 1, wherein said matrix of signal wiring is arranged such that common wiring is formed for every column.

7. The two-dimensional color display device as defined in claim 1, wherein the plurality of luminous elements includes different color light emitting diodes associated with one another, and wherein said matrix of signal wiring is arranged such that common wiring is formed for every color.

8. A two-dimensional color display device allowing selective generation of a broad range of colors, said device comprising:

a plurality of luminous elements each having luminous wavelengths different from each other collectively formed so as to be disposed on a flexible substrate in an N×M matrix, said flexible substrate being periodically thinned so as to facilitate rolling of the device, an emission intensity and a luminous color of each of said luminous elements being separately controllable from those of other ones of said luminous elements, said controllability being conducted on the basis of selective variation of a time series pulse which is applied to said luminous element, such that each luminous element emits a desired emission intensity and luminous color, and a collective emission intensity and luminous color of adjacent ones of said luminous elements effect display of a desired color, one of said luminous elements being controlled so that the emission intensity thereof is different from the emission intensity of at least one other luminous element when said one and said at least one other luminous element emit light, and wherein N and M are each an integer not less than 2; and signal wiring connected to said luminous elements, said signal wiring being arranged in a matrix.

9. A color display device according to claim 8, characterized in that said luminous elements are light emission diodes.

10. A color display device according to claim 9 characterized in that wiring is formed to provide connection to each of said luminous elements, wherein at least a portion of said wiring is at least one of: made common; includes a common portion; and includes a portion in which common wiring is formed two-dimensionally so as to be arranged in a matrix for at least one of every color and every position.

11. The two-dimensional color display device as defined in claim 8, wherein said substrate includes notches between rows and columns of said matrix so as to facilitate rolling of the device.

12. The two-dimensional color display device as defined in claim 8, wherein said matrix of signal wiring is arranged such that common wiring is formed for every row.

13. The two-dimensional color display device as defined in claim 8, wherein said matrix of signal wiring is arranged such that common wiring is formed for every column.

14. The two-dimensional color display device as defined in claim 8, wherein the plurality of luminous elements includes different color light emitting diodes associated with one another, and wherein said matrix of signal wiring is arranged such that common wiring is formed for every color.

15. A color display device allowing selective generation and display of a broad range of colors, said device comprising a plurality of luminous elements each having luminous wavelengths different from each other collectively formed so as to be disposed on a flexible substrate in an N×M matrix, said flexible substrate being periodically thinned so as to facilitate rolling of the device, in that at least one side of said matrix is wired by at least one of evaporation and plating, an emission intensity and a luminous color of each of said luminous elements being separately controllable from those of other ones of said luminous elements, said control being conducted on the basis of selective variation of a time series pulse which is applied to said luminous element, such that each luminous element emits a desired emission intensity and luminous color, and a collective emission intensity and luminous color of adjacent ones of said luminous elements effect display of a desired color, one of said luminous elements being controlled so that the emission intensity thereof is different from the emission intensity of at least one other luminous element when said one and said at least one other luminous element emit light, and wherein N and M are each an integer not less than 2; and signal wiring connected to said luminous elements. said signal wiring being arranged in a matrix.

16. A color display device according to claim 15, characterized in that said luminous elements are light emission diodes.

17. A color display device according to claim 16 characterized in that wiring is formed to provide connection to each of said luminous elements, wherein at least a portion of said wiring is at least one of: made common; includes a common portion; and includes a portion in which common wiring is formed two-dimensionally so as to be arranged in a matrix for at least one of every color and every position.

18. The two-dimensional color display device as defined in claim 15, wherein said structure includes notches between rows and columns of said matrix so as to facilitate rolling of the device.

19. The two-dimensional color display device as defined in claim 15, wherein said matrix of signal wiring is arranged such that common wiring is formed for every row.

20. The two-dimensional color display device as defined in claim 15, wherein said matrix of signal wiring is arranged such that common wiring is formed for every column.

21. The two-dimensional color display device as defined in claim 15, wherein the plurality of luminous elements includes different color light emitting diodes associated with one another, and wherein said matrix of signal wiring is arranged such that common wiring is formed for every color.

22. A color display device according to claim 8 or 5, characterized in that said luminous elements are of at least three colors of red, yellowish green, and blue.

23. A color display device according to claim 22, characterized in that said luminous elements are light emission diodes.

24. A color display device according to claim 23 characterized in that wiring is formed to provide connection to each of said luminous elements, wherein at least a portion of said wiring is at least one of: made common; includes a common portion; and includes a portion in which common wiring is formed two-dimensionally so as to be arranged in a matrix for at least one of every color and every position.

* * * * *